US009328524B1

(12) United States Patent
Cuellar

(10) Patent No.: US 9,328,524 B1
(45) Date of Patent: May 3, 2016

(54) POOL CONE

(71) Applicant: Jose Cuellar, Norfolk (MX)

(72) Inventor: Jose Cuellar, Norfolk (MX)

( * ) Notice: Subject to any disclaimer, the term of this patent is extended or adjusted under 35 U.S.C. 154(b) by 0 days.

(21) Appl. No.: 14/563,164

(22) Filed: Dec. 8, 2014

(51) Int. Cl.
*E04H 4/00* (2006.01)
*E04H 4/10* (2006.01)

(52) U.S. Cl.
CPC . *E04H 4/108* (2013.01); *E04H 4/00* (2013.01)

(58) Field of Classification Search
CPC ..... E04H 4/10
USPC ..... 4/488–513
See application file for complete search history.

(56) References Cited

U.S. PATENT DOCUMENTS 1,331,018 A * 2/1920 Luthy ..... H01M 2/18 429/143
1,669,611 A * 5/1928 Goldberg ..... E04H 15/26 135/114
1,746,487 A * 2/1930 Martin ..... A47G 25/10 211/196
3,128,478 A * 4/1964 Beal ..... E04H 4/10 4/499
3,287,740 A * 11/1966 Langer ..... E04H 4/10 220/216
3,521,416 A * 7/1970 Joor ..... E04H 7/065 220/220
3,523,308 A * 8/1970 Bradley ..... E04H 4/10 4/503
3,889,698 A * 6/1975 Roessl ..... E04H 15/28 135/116
4,136,408 A * 1/1979 Dahlbeck ..... A01G 9/16 4/498
4,813,442 A * 3/1989 Haines ..... E04H 9/02 135/20.3
4,951,327 A * 8/1990 Del Gorio, Sr. ..... E04H 4/108 135/114
5,259,077 A * 11/1993 Hager ..... E04H 4/108 135/142
5,303,527 A * 4/1994 Perez ..... E04H 4/108 249/205
5,371,907 A * 12/1994 Horvath ..... E04H 4/108 4/498
5,517,702 A * 5/1996 Fraher ..... E04H 4/108 248/161
5,678,587 A * 10/1997 Bilotti ..... E04H 15/28 135/16
D388,180 S * 12/1997 Weihbrecht ..... E04H 4/108 D25/2
5,706,531 A * 1/1998 Aubertine ..... E04H 4/108 4/496
5,943,709 A * 8/1999 Chiu ..... E04H 4/0056 4/498
6,223,358 B1 * 5/2001 DePietro ..... A63B 61/003 248/157
6,250,322 B1 * 6/2001 Porter ..... A45B 23/00 135/15.1
6,324,792 B1 * 12/2001 DeGarie ..... E04B 7/10 403/217
6,349,497 B1 * 2/2002 Roddenbery ..... A01M 31/06 43/2
6,385,793 B1 * 5/2002 Sanddal ..... A47K 3/001 248/205.5
6,442,773 B1 * 9/2002 Kopyar ..... E04H 4/108 4/498
6,807,688 B1 * 10/2004 Popowski ..... E04H 4/108 4/498
D512,514 S * 12/2005 Calvaruso ..... E04H 4/108 D25/2
D571,481 S * 6/2008 Gray ..... E04H 4/108 D25/2
8,132,274 B1 * 3/2012 Peterman ..... E04H 4/106 4/498
2005/0072055 A1 * 4/2005 Martin ..... E04H 4/108 52/3
2007/0199142 A1 * 8/2007 Gray ..... E04H 4/08 4/498
2012/0137422 A1 * 6/2012 Winters ..... E04H 4/106 4/499

FOREIGN PATENT DOCUMENTS

WO 2011066601 6/2011

* cited by examiner

*Primary Examiner* — Lori Baker
(74) *Attorney, Agent, or Firm* — Shaddock Law Group, PC

(57) ABSTRACT

A pool cover assembly having a pole that extends from a bottom end to a top end; a socket, that is attachable to the top end of the pole; a base, that includes a pole receiving aperture formed proximate a center of the base for receiving at least a portion of the bottom end of the pole; and a pool cover canopy that includes a plug located on and underside of the circular pool cover canopy, wherein the plug is mateable with the socket, and wherein the pool cover canopy includes a drawstring style cinching line threaded through apertures formed at spaced apart locations proximate an edge of the pool cover canopy.

20 Claims, 6 Drawing Sheets

POOL CONE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of pool covers. More specifically, the present invention relates to a pool cone or a conical pool cover assembly adaptable to be used with a pool.

2. Description of Related Art

It is generally known that large municipal pools are typically drained at the end of the season. In contrast, consumer owned above ground pools are generally kept filled and are fitted with a cover to keep animals, leaves, dirt, debris, and rubbish from getting into the pool. Unfortunately, such materials can still accumulate on such covers, even to the point where such materials can rupture the cover or at least pull the cover out of position.

Oft times, pool owners will place a large inflatable ball under such a cover to help by inclining the cover upward, causing such materials to shed off of the cover. Unfortunately, inflatable balls are not particularly durable and have a tendency to move towards the outer circumference of the pool due to winds, thereby limiting their effectiveness.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Thus, typical pool cover arrangement has various shortcomings.

To overcome the shortcomings of current pool covers and to provide an improved, more durable pool cover, the pool cover assembly of the present invention has been conceived as an improved solution to this problem. In various exemplary, nonlimiting embodiments, the pool cover assembly of the present invention comprises at least some of a teepee or tent style pool cover.

In various exemplary, non-limiting embodiments, the pool cover assembly of the present invention comprises a pole that mounts in a base. The pool cover canopy includes a drawstring style cinching rope or wire threaded through apertures formed proximate the edge of the pool cover canopy. A socket is seated atop the pole and a mating plug is centrally located at a on the underside of the circular pool cover canopy.

In various exemplary, non-limiting embodiments, the pool cover assembly of the present invention comprises a pole that extends from a bottom end to a top end; a socket, that is attachable to the top end of the pole; a base, that includes a pole receiving aperture formed proximate a center of the base for receiving at least a portion of the bottom end of the pole; and a pool cover canopy that includes a plug located on and underside of the circular pool cover canopy, wherein the plug is mateable with the socket, and wherein the pool cover canopy includes a drawstring style cinching line threaded through apertures formed at spaced apart locations proximate an edge of the pool cover canopy.

During use, the base is placed on the bottom of the pool, at its center, and the pole is positioned so as to extend upwardly from the base. The pool cover canopy is positioned such that the socket is seated within the plug and the remaining portions of the pool cover canopy are draped over the side walls of the pool. Once properly positioned, the drawstring style cinching wire is pulled tight, so that the bottom portion of the pool cover canopy is drawn into a tight, frictional engagement with the sidewalls of the pool.

Accordingly, the presently disclosed invention provides a pool cover assembly having a good level of strength and durability.

The presently disclosed invention separately provides a conical pool cover assembly that is a more effective means of covering a pool than a traditional flat cover supported by an inflatable ball.

The presently disclosed invention separately provides a conical pool cover assembly that provides a more effective and reliable means of excluding water, snow, leaves, dirt, and debris from a pool.

The presently disclosed invention separately provides a pool cover assembly that is not as susceptible to being blown out of position.

The presently disclosed invention separately provides a pool cover assembly that can be easily assembled and disassembled by a user.

The presently disclosed invention separately provides a pool cover assembly that greatly reduces the amount of effort required to open a pool at the beginning of the season.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
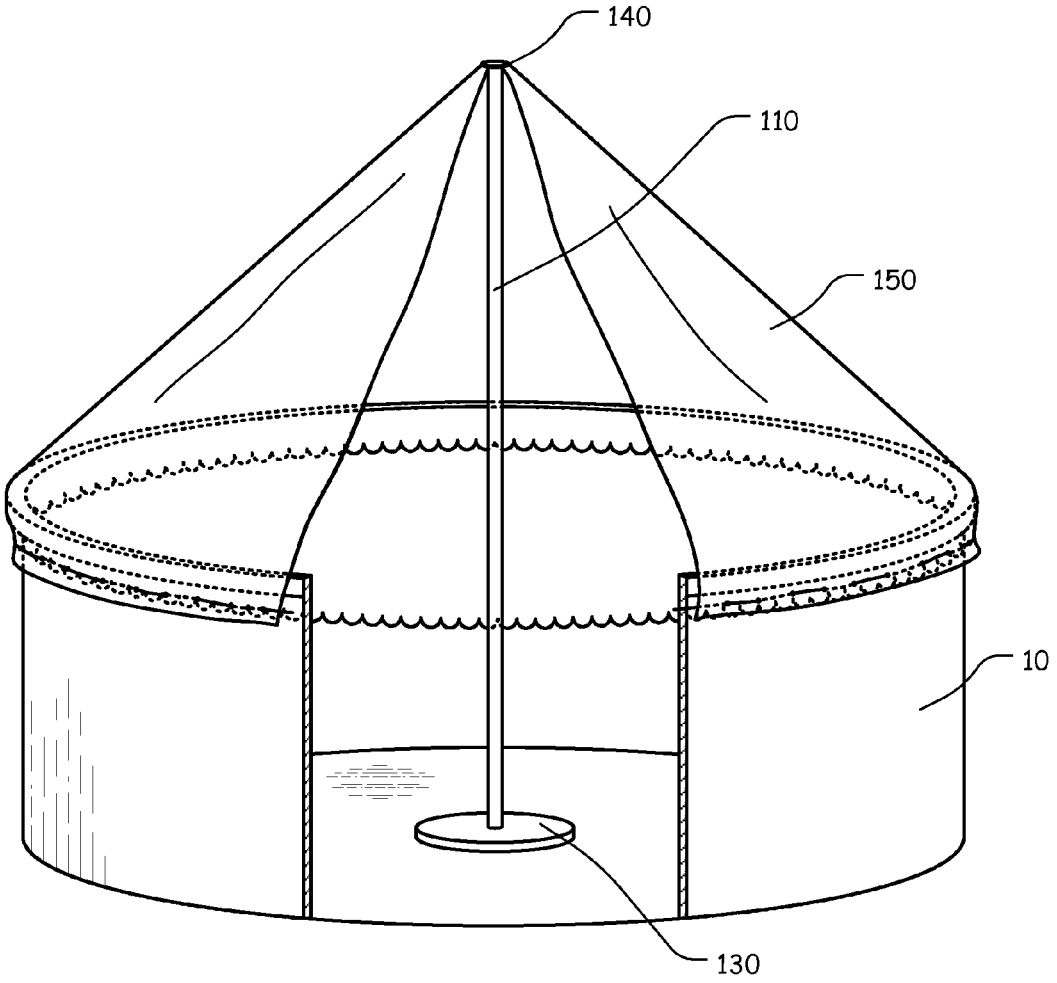
FIG. 1 illustrates a partial cutaway view of a first exemplary embodiment of the pool cover assembly, according to this invention.
Figure 2:
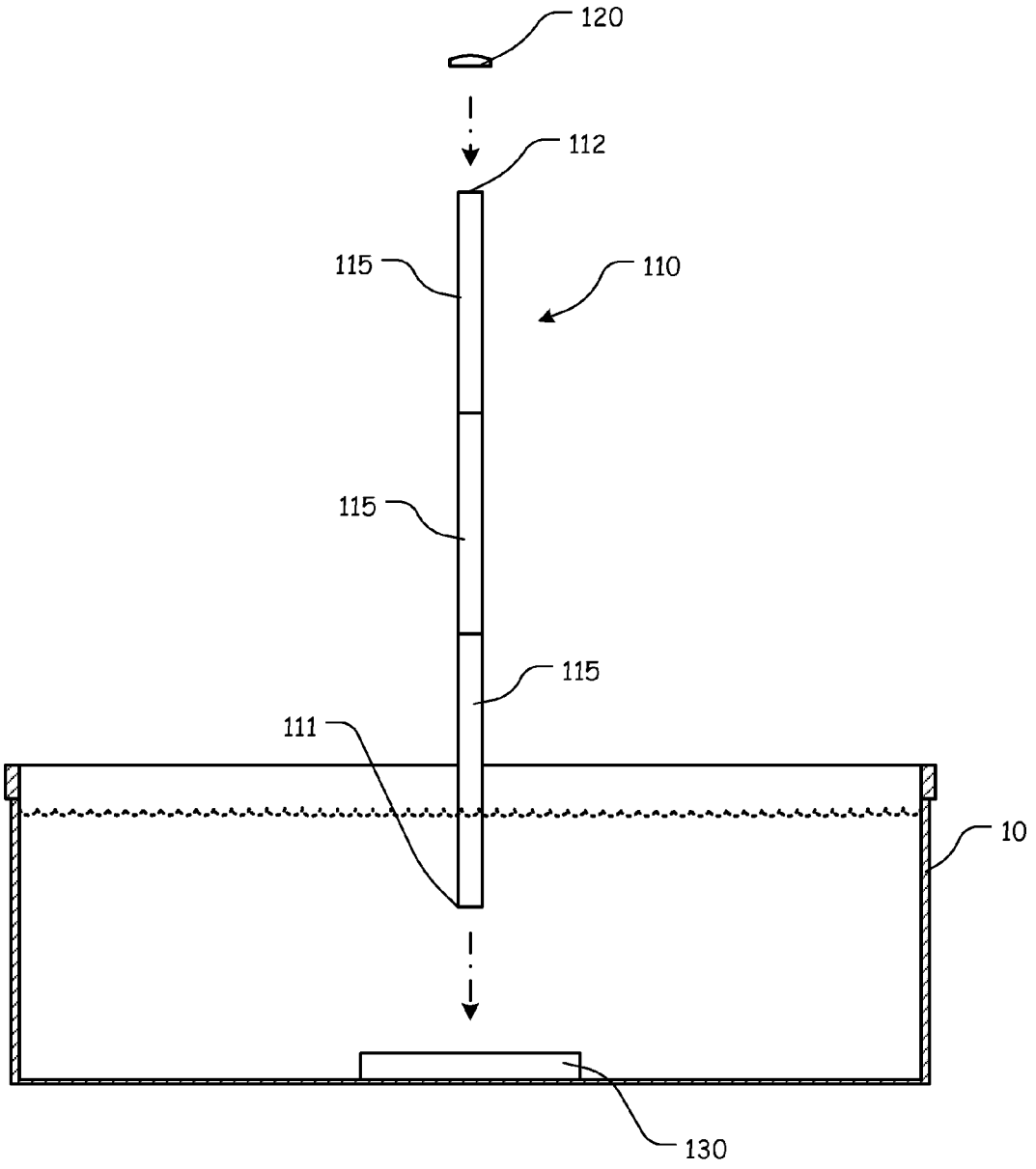
FIG. 2 illustrates a first, more detailed view of the pole, socket, and base of an exemplary embodiment of the pool cover assembly being assembled within an exemplary pool, according to this invention.
Figure 3:
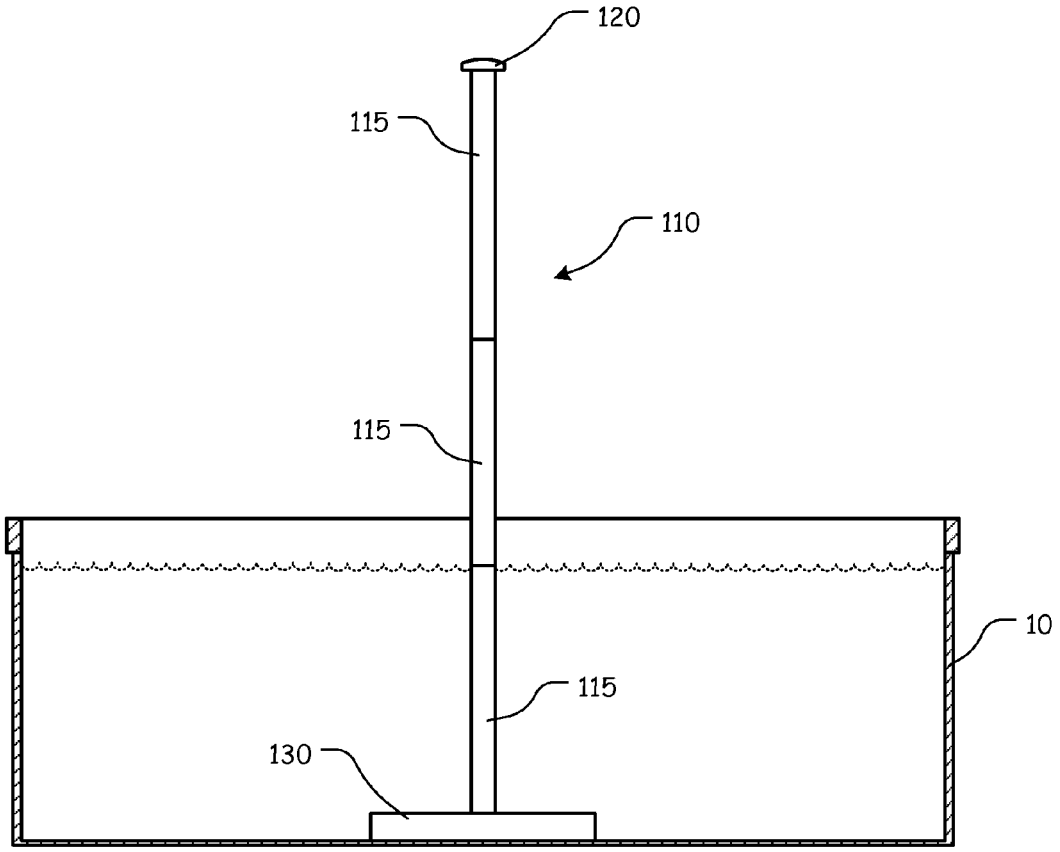
FIG. 3 illustrates a second, more detailed view of the pole, socket, and base of an exemplary embodiment of the pool cover assembly assembled within an exemplary pool, according to this invention.
Figure 4:
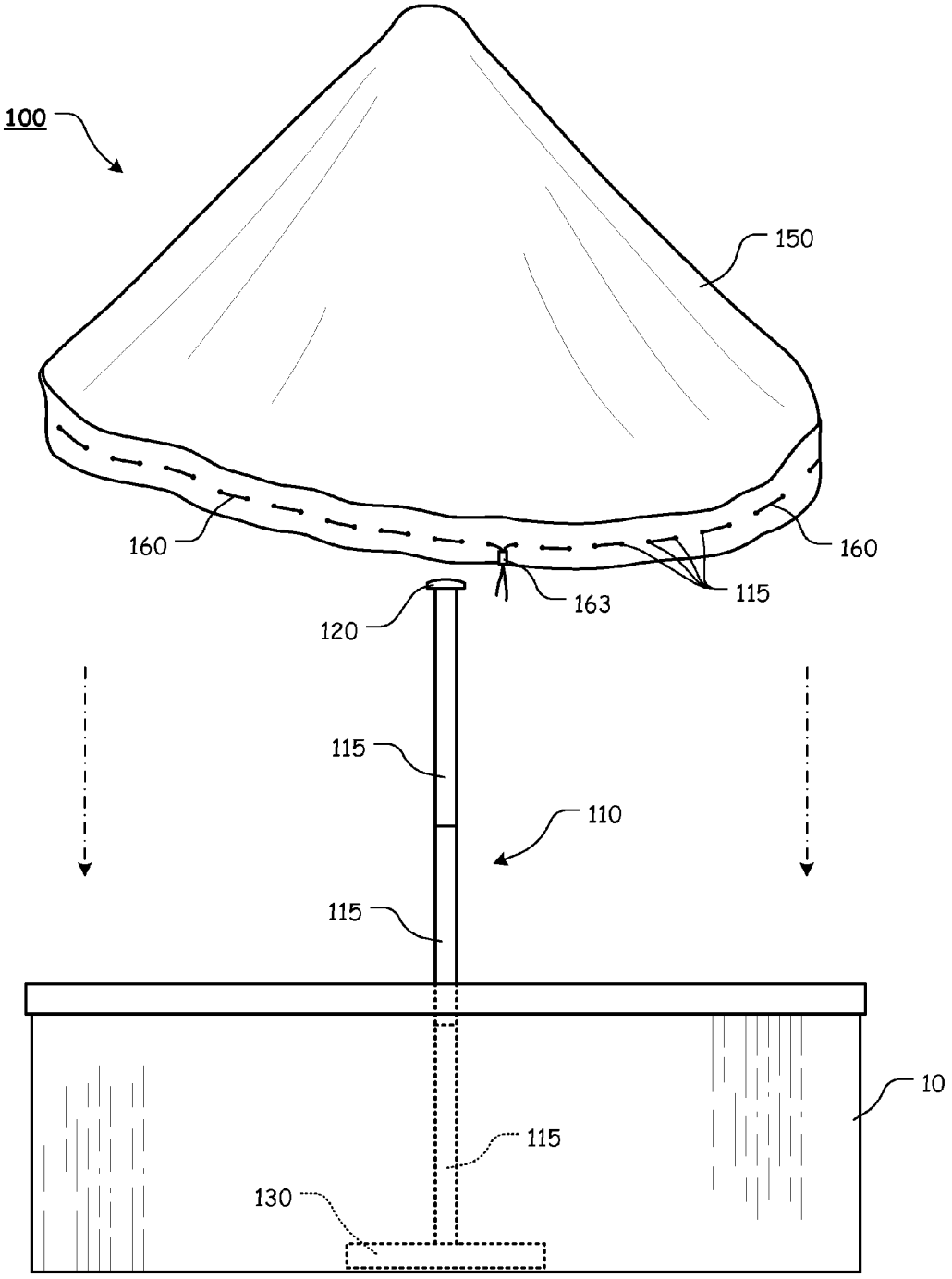
FIG. 4 illustrates a more detailed view of the pole, socket, base, and cover of an exemplary embodiment of the pool cover assembly being assembled within an exemplary pool, according to this invention.
Figure 5:
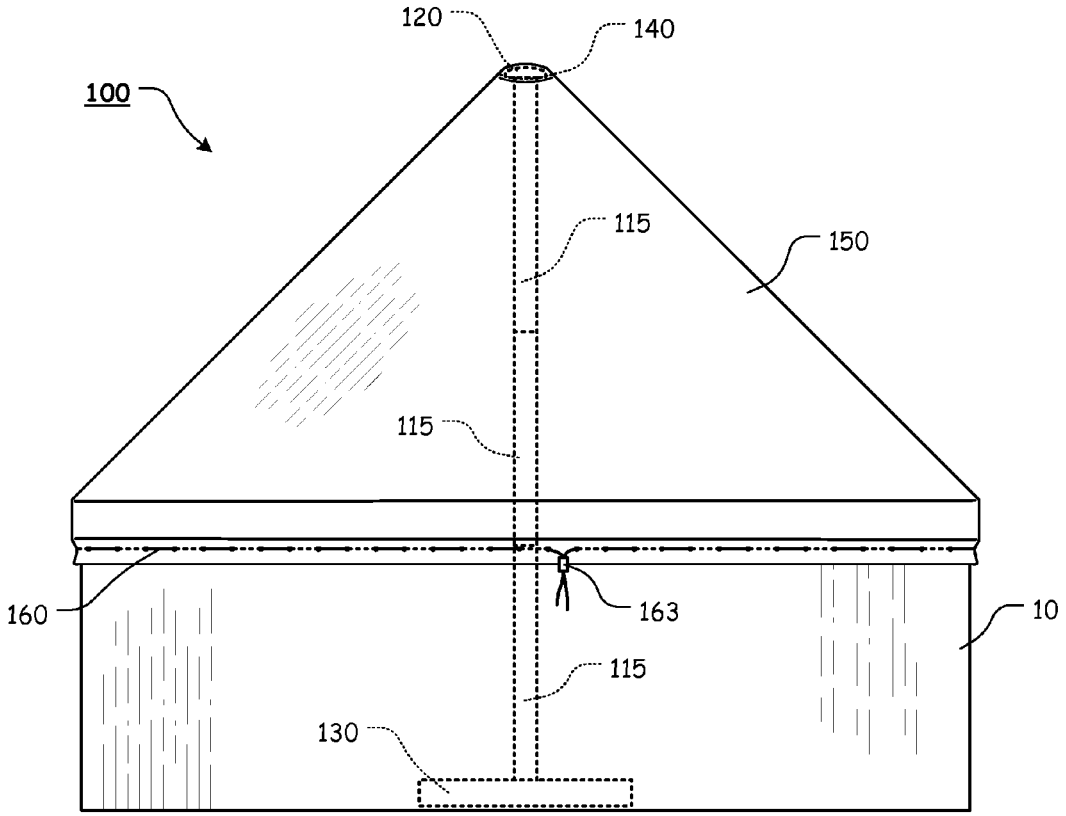
FIG. 5 illustrates a more detailed view of the pole, socket, base, and cover of an exemplary embodiment of the pool cover assembly assembled within an exemplary pool, according to this invention.
Figure 6:
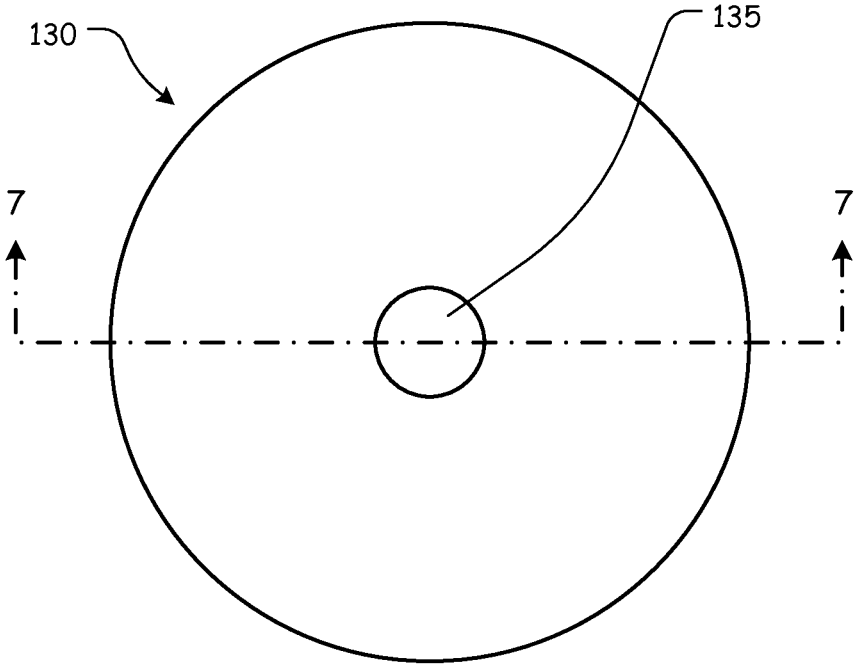
FIG. 6 illustrates a top view of a first exemplary embodiment of a base, according to this invention.
Figure 7:
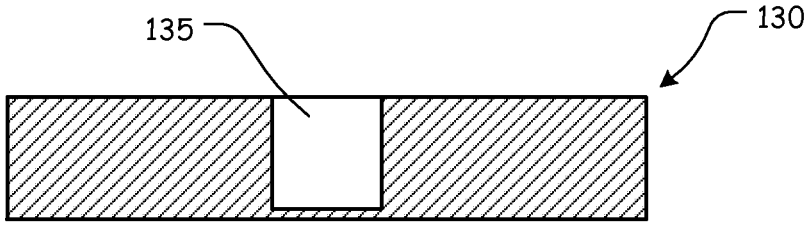
FIG. 7 illustrates a side cutaway view taken along line 7-7 of FIG. 6, of the first exemplary embodiment of the base, according to this invention.

For simplicity and clarification, the design factors and operating principles of the pool cover assembly according to this invention are explained with reference to various exemplary embodiments of a pool cover assembly according to this invention. The basic explanation of the design factors and operating principles of the pool cover assembly is applicable for the understanding, design, and operation of the pool cover assembly of this invention. It should be appreciated that the pool cover assembly can be adapted to many applications where a pool cover assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "conical", "pool cover", and "conical pool cover" are used for basic explanation and understanding of the operation of the systems, methods, and apparatuses of this invention. Therefore, the terms "conical", "pool cover", and "conical pool cover" are not to be construed as limiting the systems, methods, and apparatuses of this invention.

For simplicity and clarification, the pool cover assembly of this invention will be described as being used in conjunction with an above ground, circular swimming pool 10. However, it should be appreciated that these are merely exemplary embodiments of the pool cover assembly and are not to be construed as limiting this invention. Thus, the pool cover assembly of this invention may be utilized in conjunction with any size or shape swimming pool 10.

Turning now to the drawing FIGS., FIGS. 1-7 illustrate certain elements and/or aspects of a first exemplary embodiment of a substantially conical pool cover assembly 100, according to this invention. In illustrative, non-limiting embodiment(s) of this invention, as illustrated in FIGS. 1-7, the pool cover assembly 100 comprises a pole 110, a socket 120, a base 130, a plug 140, and a drawstring style cinching line 160.

The pole 110 extends from a bottom end 111 to a top end 112. In various exemplary embodiments, the pole 110 is substantially rigid and formed of stainless steel. Alternate materials of construction of the various components of the pole 110 may include one or more of the following: steel, aluminum, titanium, and/or other metals, as well as various alloys and composites thereof, glass-hardened polymers, polymeric composites, polymer or fiber reinforced metals, carbon fiber or glass fiber composites, fiberglass, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the pole 110 is a design choice based on the desired appearance and functionality of the pole 110.

In certain exemplary embodiments, the pole 110 comprises a single, 1 inch diameter pipe that extends approximately 12 foot from the bottom end 111 to the top end 112. In certain alternate embodiments, the pole 110 comprises two or more segmented, interlocking pole portions 115. In these embodiments, each pole portion 115 may be identical to each other pole portion 115. For example, a come posit pole 110 may be formed of 3 interlocking pole portions 115, each having a length of approximately 4 feet.

Alternatively, one or more pole portions 115 may comprise a different diameter, length, or profile from certain of the other pole portions 115. It should be understood that no matter the configuration of a particular pole portion 115, each of the pole portions 115 can interact, in an interlocking fashion, with at least one other pole portion 115, to form a composite pole 110.

The socket 120 is permanently or removably attachable to the top end 112 of the pole 110. The socket 120 is formed so as to accept a mating portion of a plug 140, which is attached or coupled to the cover 150. In certain exemplary embodiments, the socket 120 is a ring, such as, for example, a 2 inch diameter ring, that is permanently or removably attached to the top end 112 of the pole 110. Alternatively, the socket 120 may be formed as an integral portion of the pole 110 and may, for example, comprise an aperture formed through at least a portion of the pole 110.

The base 130 includes a pole receiving aperture 135 formed proximate a center of the base 130 for receiving at least a portion of the bottom end 111 of the pole 110. As illustrated most clearly in FIGS. 6-7, the base optionally comprises a substantially cylindrical portion of material having a pole receiving aperture 135 formed proximate a center of the base 130. The base 130 may be formed of a plastic or rubber material.

The pole receiving aperture 135 may merely be formed in the material used to form the base 130. Alternatively, the pole receiving aperture may be formed by a sleeve or cup positioned within the base 130.

Figure 8:
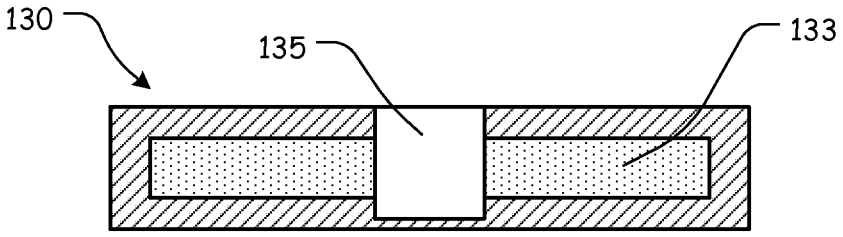
FIG. 8 illustrates a side cutaway view of a $2^{nd}$ exemplary embodiment of the base, according to this invention.

As illustrated in FIG. 8, the base 130 may include a core portion 133 that is at least partially encapsulated within a rubber portion. The core portion 133 generally adds weight and/or rigidity to the base 130. In various exemplary embodiments, the core portion 133 may be formed of a dense plastic, metal, or other material based upon the desired density and/or rigidity of the core portion 133.

As illustrated, the pool cover canopy 150 is substantially circular and includes a plug 140 located on an underside of the pool cover canopy 150. The plug 140 is formed so as to mateingly interact with the socket 120 atop the pole 110. The plug 140 may optionally comprise a 1¼ inch ring attached on the underside of the circular pool cover canopy 150.

In various exemplary, non-limiting embodiments, all or portions of the pool cover canopy 150 may be made of any fabric or other material, such as, for example, woven fabrics, canvas, synthetic canvas, acrylics, sheet fabrics, films, nylon, spandex, vinyl, Polyvinyl Chloride (PVC), neoprene, or the like. Additionally, all or portions of the pool cover canopy 150 may be made of any flexible and/or elastic material and may stretch. Alternatively, all or portions of the pool cover canopy 150 may be formed from multiple, similar or dissimilar materials. In various exemplary, non-limiting embodiments, the pool cover canopy 150 may be water-resistant, water impervious, or water pervious.

It should be appreciated that the terms fabric and material are to be given their broadest meanings and that the particular fabric(s) or material(s) used to form the pool cover canopy 150 is a design choice based on the desired appearance and/or functionality of the pool cover.

While the pool cover canopy 150 is illustrated and primarily described as being substantially circular, it should be appreciated that the pool cover canopy 150 may comprise a substantially oval, rectangular, or other shape, depending upon the size and shape of the pool 10 with which the pool cover assembly 100 is designed to be used with.

The pool cover canopy 150 includes a drawstring style cinching line 160 threaded through apertures 155 formed at spaced apart locations proximate an edge of the pool cover canopy 150. The cinching line 160 may comprise a portion of cable, cord, wire, rope, string, or an equivalent. It should be appreciated that the cinching line 160 may be relatively elastic or non-elastic. The cinching line 160 may comprise a ⅛ inch line or line of similar size.

In certain exemplary embodiments, the apertures 155 are formed at spaced apart locations that approximately 2 foot apart. It should be appreciated that the locations may be greater than or less than 2 feet, as desired. Additionally, each of the apertures 155 may be defined by a grommet or reinforcing ring, which allows the cinching line 162 more easily slide within the apertures 155 and also protects the integrity of the material used to form the pool cover canopy 150.

A cord lock 163 is used to join to opposing ends of the cinching line 160. The cord lock 163 is typically releasably attached to the cinching line 160 such that the cord lock 163 can be adjusted along the link of the cinching line 160.

It should be appreciated that certain elements of the pool cover assembly 100 may be formed as an integral unit (such as, for example, the pole 110 and/or the base 130). Alternatively, suitable materials can be used and sections or elements made independently and attached or coupled together, such as by frictional engagement, adhesives, welding, screws, rivets, pins, or other fasteners, to form the various elements of the pool cover assembly 100.

It should also be understood that the overall size and shape of the pool cover assembly 100, and the various portions thereof, is a design choice based upon the desired functionality and/or appearance of the pool cover assembly 100.

During installation, the base 130 is typically placed at the bottom of the pool 10, at a relative center of the pool 10. If necessary, pole 110 is assembled by joining the one or more pole portions 115. The bottom in 111 of the pole 110 is placed within the pole receiving aperture 135 of the base 130.

If necessary, the socket 120 is positioned at the top end 112 of the pole 110.

The pool cover canopy 150 is then positioned atop the socket 120, such that the socket 120 is at least partially received within the plug 140.

The outer edges of the pool cover canopy 150 are then draped over the lip of the pool 10 such that the portion of the pool cover canopy 150 that includes the cinching line 160 is placed below the upper lip of the pool 10.

Once the pool cover canopy 150 is appropriately positioned around the pool 10, the ends of the cinching line 160 are pulled such that the cinching line 160 slides within the apertures 155, relative to the pool cover canopy 150, shortening the length of the cinching line 160 encircling the pool cover canopy 150 and retracting the circumference of the lower portion of the pool cover canopy 150 is reduced, providing a friction fit between the pool cover canopy 150 and the outer surface of the pool 10.

When an appropriate frictional fit has been established, the cord lock 163 is utilized to maintain the cinching line 160 in a desired position.

Removal of the pool cover canopy 150 can be easily accomplished by releasing the cord lock 163 such that tension on the cinching line 160 is removed and the pool cover canopy 150 can be removed from the pool 10. Then, the pole 110 and base 130 can be removed from the pool 10 for a complete removal of the pool cover assembly 100.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A pool cover assembly, comprising:

a pole, wherein said pole extends from a bottom end to a top end;

a socket, wherein said socket is attachable to said top end of said pole;

a base, wherein said base includes a pole receiving aperture formed proximate a center of said base for receiving at least a portion of said bottom end of said pole; and a pool cover canopy, wherein said pool cover canopy includes a plug attached or coupled to at least an underside of said circular pool cover canopy, wherein said plug is mateable with said socket, and wherein said pool cover canopy includes a drawstring style cinching line threaded through apertures formed at spaced apart locations proximate an edge of said pool cover canopy.

2. The pool cover assembly of claim 1, wherein said pole comprises fiberglass or aluminum.

3. The pool cover assembly of claim 1, wherein said pole comprises a 1 inch diameter pipe.

4. The pool cover assembly of claim 1, wherein said pole extends approximately 12 foot from said bottom end to said top end.

5. The pool cover assembly of claim 1, wherein said pole comprises two or more segmented, interlocking pole portions.

6. The pool cover assembly of claim 5, wherein each segmented, interlocking pole portion comprises a four foot pole portion.

7. The pool cover assembly of claim 1, wherein said socket is removably attached atop said pole.

8. The pool cover assembly of claim 1, wherein said socket is formed as an integral portion of said pole.

9. The pool cover assembly of claim 1, wherein said socket comprises an aperture formed in said pole.

10. The pool cover assembly of claim 1, wherein said socket comprises a 2 inch ring around said pole.

11. The pool cover assembly of claim 1, wherein said base comprises rubber.

12. The pool cover assembly of claim 1, wherein said base comprises a central, metal portion, wherein said metal portion is at least partially encapsulated within a rubber portion.

13. The pool cover assembly of claim 1, wherein said pool cover canopy is substantially circular.

14. The pool cover assembly of claim 1, wherein said pool cover canopy is substantially oval shaped.

15. The pool cover assembly of claim 1, wherein said pool cover canopy is substantially rectangular.

16. The pool cover assembly of claim 1, wherein said cinching line comprises a portion of cable, cord, wire, rope, string, or an equivalent.

17. The pool cover assembly of claim 1, wherein said cinching line comprises a ⅛ inch line.

18. The pool cover assembly of claim 1, wherein said pool cover canopy comprises a synthetic canvas.

19. The pool cover assembly of claim 1, wherein said plug comprises a 1¼ inch ring attached on said underside of said circular pool cover canopy.

20. The pool cover assembly of claim 1, wherein said apertures are formed at spaced apart locations that are 2 foot apart.

* * * * *